US005752881A

United States Patent [19]

Inoue

[11] Patent Number: 5,752,881

[45] Date of Patent: May 19, 1998

[54] SYMBOL DISPLAY DEVICE AND GAMING MACHINE INCLUDING THE SAME

[75] Inventor: Haruo Inoue, Tokyo, Japan

[73] Assignee: Eagle Co., Ltd., Tokyo, Japan

[21] Appl. No.: 713,970

[22] Filed: Sep. 12, 1996

[30] Foreign Application Priority Data

Sep. 12, 1995 [JP] Japan ..... 7-233856

[51] Int. Cl.[6] ..... G07F 17/34

[52] U.S. Cl. ..... 463/20; 273/143 R

[58] Field of Search ..... 273/143 R, 138.2; 463/20

[56] References Cited

U.S. PATENT DOCUMENTS

| | | | |
|---|---|---|---|
| 5,135,224 | 8/1992 | Yamamoto et al. | 273/143 R |
| 5,152,529 | 10/1992 | Okada | 273/143 R |
| 5,395,111 | 3/1995 | Inoue | 273/143 R |

FOREIGN PATENT DOCUMENTS

| | | | |
|---|---|---|---|
| 406218092 | 8/1994 | Japan | 273/143 R |
| 2165074 | 4/1986 | United Kingdom | 273/143 R |
| 2233806 | 1/1991 | United Kingdom | 273/143 R |

*Primary Examiner*—Benjamin H. Layno
*Attorney, Agent, or Firm*—Young & Thompson

[57] ABSTRACT

A symbol display device for a gaming machine has a display window wherein any of a plurality of different symbols is stopped. An outer reel is rotatable behind the display window. The symbols are spaced peripherally about the outer reel. Each of the symbols is transparent with an opaque portion disposed inside and/or outside the transparent symbol. The peripheral face of the outer reel is opaque outside the transparent symbol. An inner reel is rotatable inside the outer reel. A plurality of different colored patterned portions are disposed in a peripheral series about the inner reel. Any of the patterned portions can be stopped in the display window. One of the patterned portions stopped in the display window becomes observable through the transparent portion when the transparent symbol is stopped in the display window, and is combined with the transparent symbol, to constitute a compound symbol. The inner and outer reels may instead be inner and outer endless belts.

15 Claims, 11 Drawing Sheets

SYMBOL DISPLAY DEVICE AND GAMING MACHINE INCLUDING THE SAME

BACKGROUND OF THE INVENTION

1. Field of the Invention

The present invention relates to a symbol display device for a gaming machine. More particularly, the present invention relates to a symbol display device adapted to be used in a gaming machine, and having at least a rotatable outer reel and a rotatable inner reel disposed inside the outer reel, or inner and outer endless belts, and to a game machine including the same.

2. Description Related of the Prior Art

There are a great number of gaming machines having a symbol display device incorporated in a front panel: a slot machine, a pinball machine, and the like. Various types of symbol display devices for a gaming machine include a reel type and a video type. The reel type includes one or more reels, on which plural symbols are arranged and which are rotated and stopped. The video type includes a ROM for storing graphic data, and a CRT or a liquid crystal display panel for displaying a simulated reel image with moving symbols according to the graphic data. In either type, symbols stopped in a display window after the end of symbol movement are checked. The stopped combination of the symbols on a winning line is determined to be a win or a loss.

A simplest type of symbol display device has one horizontal winning line defined across the plural reels. This type is advantageous, as it is easy for a player to grasp the process of a game visually.

However, the symbol display device with only one winning line has a shortcoming in that there is no variety in the game because of only small changes in symbol combinations. As soon as the reels are stopped, the symbols are immediately stopped. Games are thus likely to be uneventful. To overcome such a shortcoming, various types of symbol display devices have been proposed. In one type, there are a greater number of winning lines and a greater number of reels. Another is a double-reel type, which includes a transparent outer reel, and an inner reel disposed inside the outer reel in a rotatable manner, to increase the number of combinations of symbols.

A problem still exists in those types of symbol display devices. The apparent process of a game is so complicated that a beginner of the game finds it difficult instantaneously to discern the occurrence of a winning combination of symbols on any winning line. Beginners are likely to have a game end without grasping what the game is like. Unsolvable inconsistency remains in the prior art. When a symbol display device has a smaller number of kinds of symbols and a smaller number of winning lines, games are easy to grasp, but tend to be uneventful without continuous enjoyment. When a symbol display device has a greater number of kinds of symbols and a greater number of winning lines, games being played have considerable eventfulness and provide continuous enjoyment, but tend to require considerable time to grasp.

In the above-described double-reel type, the outer reel is transparent except for the symbols. One of the symbols about the outer reel is combined with one of the symbols about the inner reel, to define a compound symbol. However, unnecessary portions of the inner reel are visible through the outer reel. There is a problem as to the appearance of the displayed symbols, and this requires a considerable time to grasp.

OBJECTS OF THE INVENTION

In view of the foregoing problems, an object of the present invention is to provide a symbol display device for a gaming machine in which games are easy for players to grasp.

Another object of the present invention is to provide a symbol display device for a gaming machine in which games being played have considerable eventfulness and provide continuous enjoyment.

Still another object of the present invention is to provide a gaming machine that includes such a symbol display device.

SUMMARY OF THE INVENTION

In order to achieve the above and other objects and advantageous of this invention, an outer reel is rotatable behind the display window, and has a peripheral face with the different symbols spaced thereabout. The symbols include at least one transparent symbol. The transparent symbol comprises a transparent portion, and an opaque portion disposed in the vicinity of the transparent portion. At least one of the transparent portion and the opaque portion has the shape of the transparent symbol, the peripheral face of the outer reel being opaque outside the transparent portion. An inner reel is rotatable inside the outer reel. Patterned portions of plural kinds are arranged in a series on a peripheral face of the inner reel, and have colors or patterns respectively associated with the kinds thereof, any of the patterned portions being adapted to be stopped in the display window. One of the patterned portions stopped in the display window becomes observable through the transparent portion when the transparent symbol is stopped in the display window, and is combined with the transparent symbol, so as to constitute a compound symbol.

In a preferred embodiment, each of the symbols comprises a transparent symbol. The peripheral face of the outer reel is formed at least partially from transparent material, and the transparent portion is formed by coloring the peripheral face of the outer reel around the transparent portion.

The opaque portion is formed inside the transparent portion by coloring. Or the opaque portion is formed around the transparent portion, and is colored differently from the peripheral face of the outer reel.

In a variant device, the transparent portion comprises an opening formed in the outer reel. Furthermore, a transparent cover plate, sheet or film is secured to the outer reel, for closing the opening.

In another preferred embodiment, a lamp is disposed behind the display window, for illuminating the transparent portion that has stopped on the outer reel. The patterned portions are transparent or translucent at least partially. The lamp is disposed inside the inner reel. Light from the lamp is transmitted through the patterned portion and the transparent portion.

Otherwise the patterned portions have high optical reflectance at least partially. The lamp is disposed between the outer reel and the inner reel. Light from the lamp is reflected by the patterned portion, and then transmitted through the transparent portion.

In a belt type of symbol display device, a first pair of rollers are respectively disposed behind two opposite sides of the display window, for rotating in synchronism. An endless outer belt is disposed behind the display window, supported on and circulated by the first pair of rollers, the endless outer belt having a peripheral face with the symbols arranged thereon regularly. The symbols include at least one transparent symbol. The transparent symbol comprises a transparent portion, and an opaque portion disposed in the vicinity of the transparent portion. At least one of the transparent portion and the opaque portion has a shape in accordance with the transparent symbol, the peripheral face of the outer belt being opaque outside the transparent portion. A second pair of rollers are disposed between the first pair of rollers, for rotating in synchronism. An endless inner belt is disposed behind the display window, supported on and circulated by the second pair of rollers. Patterned portions of plural kinds are arranged on a peripheral face of the inner belt, and have colors or patterns respectively associated with the kinds thereof, any of the patterned portions being adapted to be stopped in the display window. The patterned portion stopped in the display window becomes observable through the transparent portion when the transparent symbol is stopped in the display window, and is combined with the transparent symbol, so as to constitute a compound symbol.

In accordance with the present invention, games are easy for players to grasp with the symbol display device for the gaming machine. Games played have considerable eventfulness and provide continuous enjoyment.

BRIEF DESCRIPTION OF THE DRAWINGS

The above objects and advantages of the present invention will become more apparent from the following detailed description when read in connection with the accompanying drawings, in which.

DETAILED DESCRIPTION OF THE PREFERRED EMBODIMENTS OF THE PRESENT INVENTION

Figure 1:
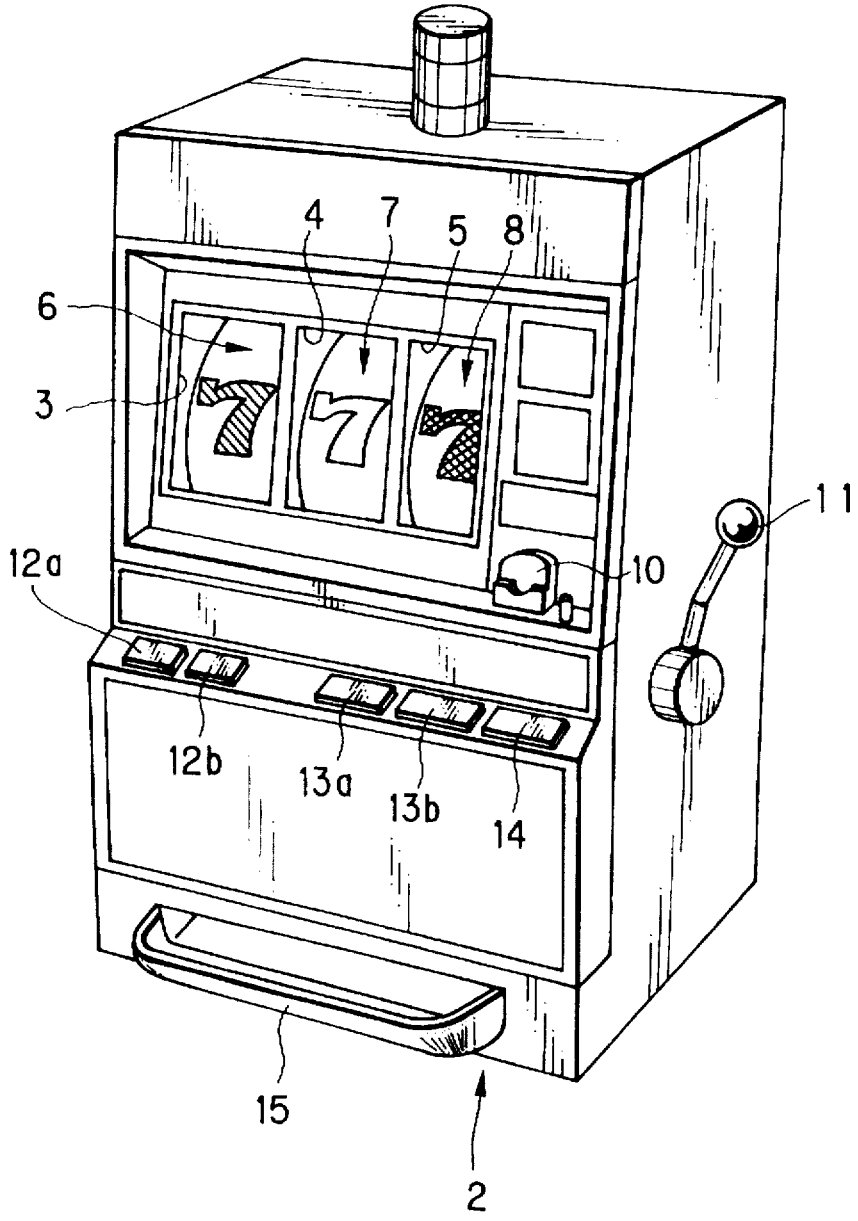
FIG. 1 is a perspective view illustrating a slot machine in which a symbol display device is used.

In FIG. 1, a slot machine 2 has three display windows 3, 4 and 5. Behind the display windows 3–5 are disposed symbol display devices of the driven reel type, which respectively consist of first, second and third reel sets 6, 7 and 8. A lateral face of the slot machine 2 has a start handle 11. The front of the slot machine 2 has a change button 12*a*, a payout button 12*b*, a one-bet button 13*a*, a maximum bet button 13*b* and a spin button 14.

Each of the reel sets 6–8 has symbol elements arranged peripherally thereabout and includes outer symbols of plural kinds and inner patterned portions, to be described later. After a coin is inserted into a coin slot 10, the reel sets 6–8 start to rotate simultaneously as soon as the start handle 11 or the spin button 14 is operated. After the lapse of a predetermined period of time, a stop signal is received to stop the reel sets 6–8. When a win is acquired as a result of the stopping of the reel sets 6–8, coins of a number associated with the win are paid out to a saucer 15.

Figure 2:
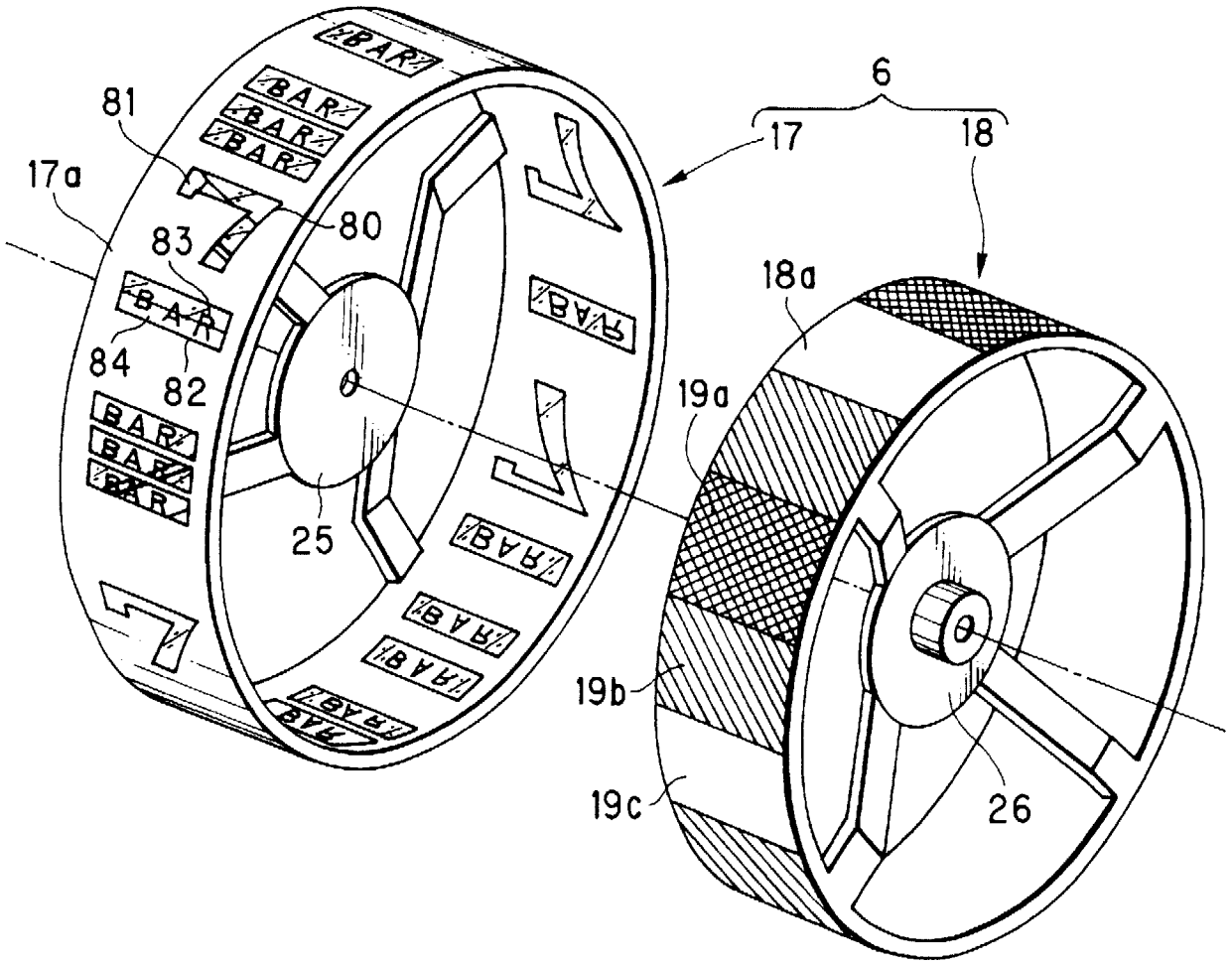
FIG. 2 is an exploded perspective view illustrating one of three reel sets.

Each of the reel sets 6–8 includes an outer reel and an inner reel. FIG. 2 structurally illustrates the first reel set 6. An outer reel 17 is formed of lightweight durable resin material. The outer reel 17 has a peripheral face 17*a* which is opaque and white. Symbols of one BAR, two BARs, three BARs and 7 (seven) are arranged on the peripheral face 17*a* at a regular pitch and in random order.

Figure 3A:
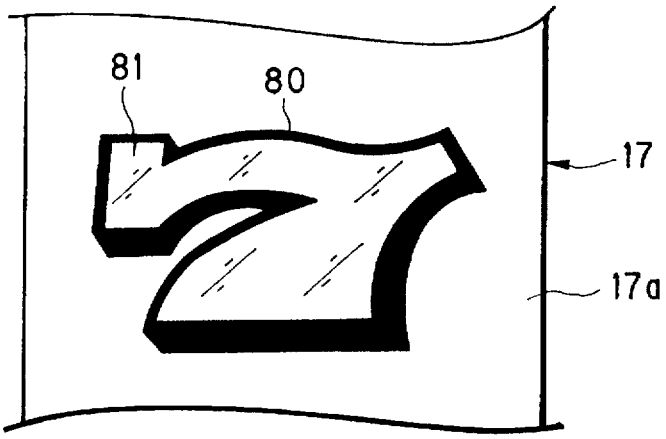
FIGS. 3A to 3C are explanatory views respectively illustrating symbols about an outer reel.

In FIG. 3A, a symbol "7" is constructed from an opaque border 80 and a transparent portion 81 formed inside the border 80. An inner reel 18 is disposed inside the outer reel 17. Through the transparent portion 81, a peripheral face of the inner reel 18 is observable. The border 80 has a different color from the peripheral face 17*a*, for example black, for ease of reading.

Figure 3B:
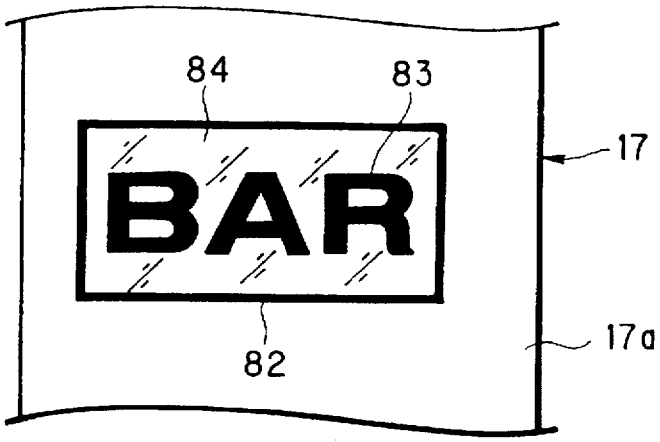

The symbol one BAR, as illustrated in FIG. 3B, has an opaque border 82 of a rectangular shape, and opaque letters 83. There is a transparent portion 84 defined inside the border 82 and outside the opaque letters 83. The symbol two BARs and three BARs are similar to the symbol one BAR. Note that it is possible that the border 82 and the opaque letters 83 can have different colors, for example black and blue.

To form the transparent portions 81 and 84, the outer reel 17 is formed from transparent resin wholly or partially. Then the borders 80 and 82 and the opaque letters 83 are drawn on the peripheral face 17*a* to obtain the transparent portions 81 and 84. Otherwise, the borders 80 and 82 and the opaque letters 83 are pre-printed on a transparent film, which is attached to the body of the outer reel 17. Then the peripheral face 17*a* is colored opaque white, leaving the transparent portions 81 and 84.

Figure 3C:
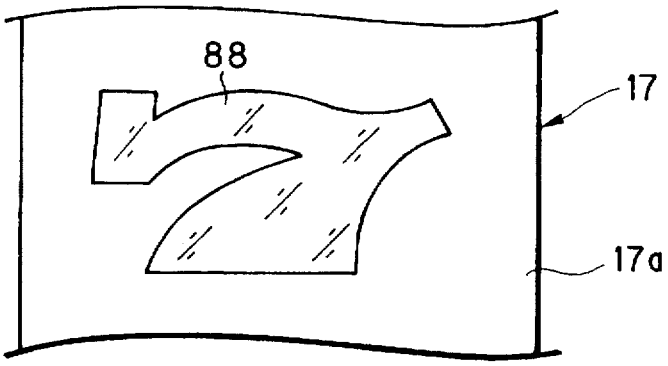

It is also possible in FIG. 3C that a transparent portion 88 is simply formed in the peripheral face 17*a* without any border thereabout. The inside of the whole of the transparent portion 88 is changed in color by a peripheral face 18*a* of the inner reel 18, in contrast to the transparent portion 81 of FIG. 3A, in which the inside of the border 80 is changed in color by the peripheral face 18*a*.

Figure 4:
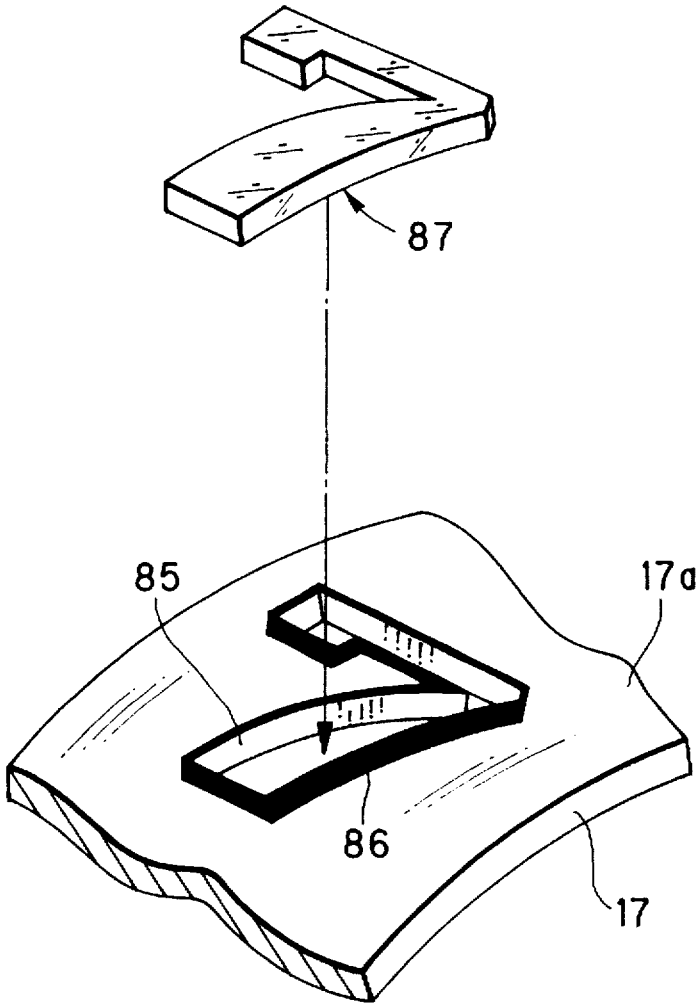
FIG. 4 is an explanatory view in perspective, illustrating another preferred manner of forming a symbol.

In FIG. 4, an opening 85 is formed in the peripheral face 17*a*. The outer reel 17 with the opening 85 may be formed from opaque white resin. In the drawing, a border 86 is formed about the opening 85 in a dark color. It is possible to eliminate the border 86. Furthermore, a transparent resin plate 87 may be fitted into the opening 85 for the purpose of preventing the opening 85 from offering air resistance and avoiding irregular rotation of the outer reel 17. Also a lens may be secured to cover the opening 85 to enlarge the patterned portion of the inner reel 18 for ease of reading. Otherwise, a transparent film or sheet may be secured across the opening 85 inside or outside the wall of the peripheral face 17*a*.

The inner reel 18 is formed of lightweight durable opaque resin material as illustrated in FIG. 2. On the peripheral face 18*a* are arranged patterned portions 19*a*, 19*b* and 19*c* colored red, blue and white, arranged in random order. The patterned portions 19a–19c are arranged behind the outer reel 17 of the first reel set 6, and are observable through the transparent portions 81 and 84 of the outer reel 17. The patterned portions 19a–19c of the inner reel 18 add their colors to the symbols of the outer reel 17. For example, the single symbol one BAR of the outer reel 17 can be varied to three compound symbols "one BAR-RED", "one BAR-BLUE" and "one BAR-WHITE".

Figure 5:
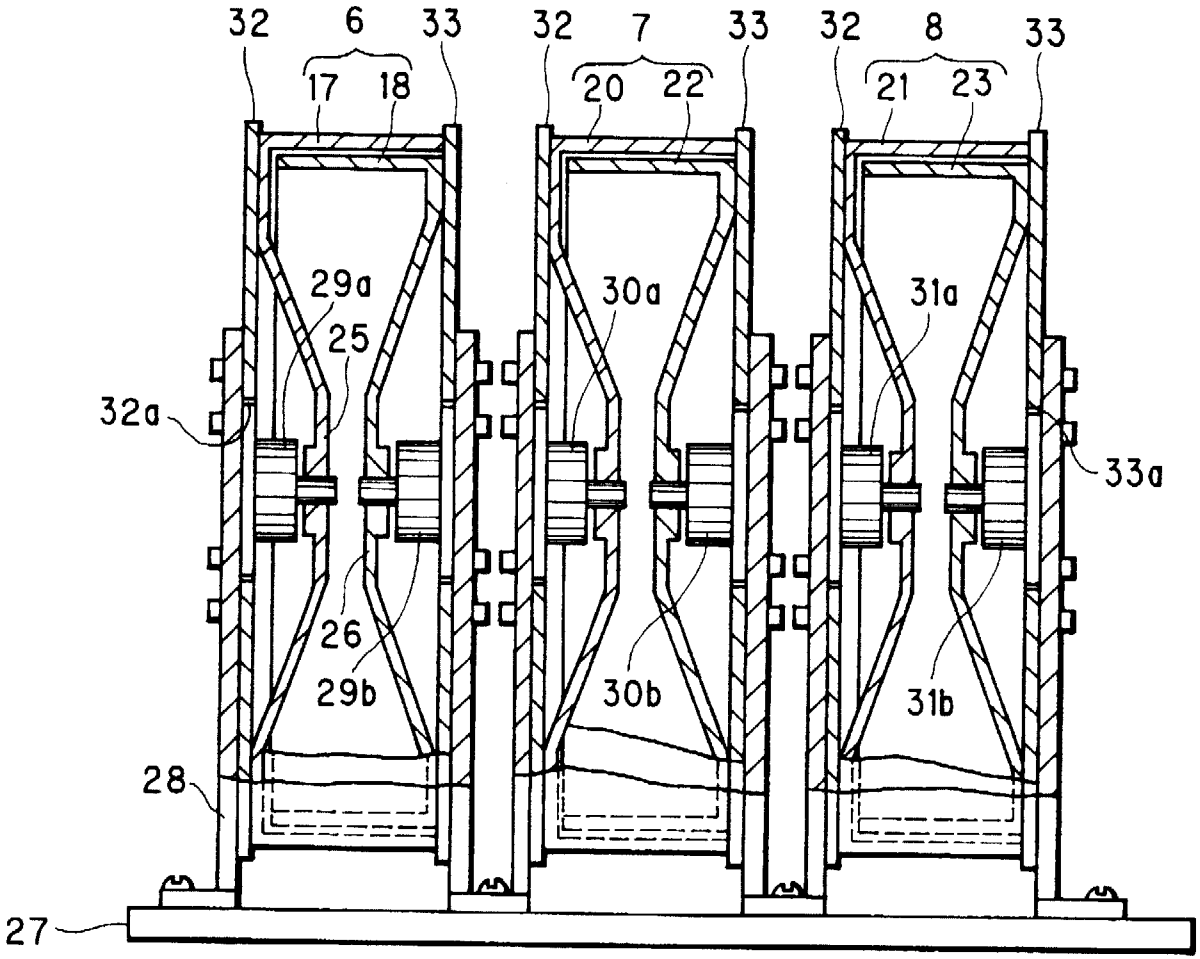
FIG. 5 is a cross section illustrating the three reel sets.

In FIG. 5, the second reel set 7 is constituted by an outer reel 20 and an inner reel 22 similarly to the first reel set 6. The third reel set 8 is constituted by an outer reel 21 and an inner reel 23. Patterned portions of the inner reels 22 and 23 are observable through transparent portions of the outer reels 20 and 21.

Securing plates 25 and 26 are respectively formed with the reels 17 and 18, and fixed to respective shafts of stepping motors. FIG. 5 illustrates a reel assembly including the reel sets 6–8 assembled together. There is a base plate 27, on which brackets 28 are fixed for supporting the reels. On the brackets 28, stepping motors 29a, 29b, 30a, 30b, 31a and 31b, and rotary support plates 32 and 33 having central openings 32a and 33a, are fixed by means of hexagonal bolts.

The outer reel 17 of the first reel set 6 is fixed on the shaft of the stepping motor 29a. The outer reels 20 and 21 of the reel sets 7 and 8 are respectively fixed on the shafts of the stepping motors 30a and 31a. The inner reel 18 of the first reel set 6 is fixed on the shaft of the stepping motor 29b. The inner reels 22 and 23 of the reel sets 7 and 8 are respectively fixed on the shafts of the stepping motors 30b and 31b. The outer reels 17, 20 and 21 are guided by contact on the inside of the support plate 32. The inner reels 18, 22 and 23 are guided by contact on the inside of the support plate 33.

Figure 6:
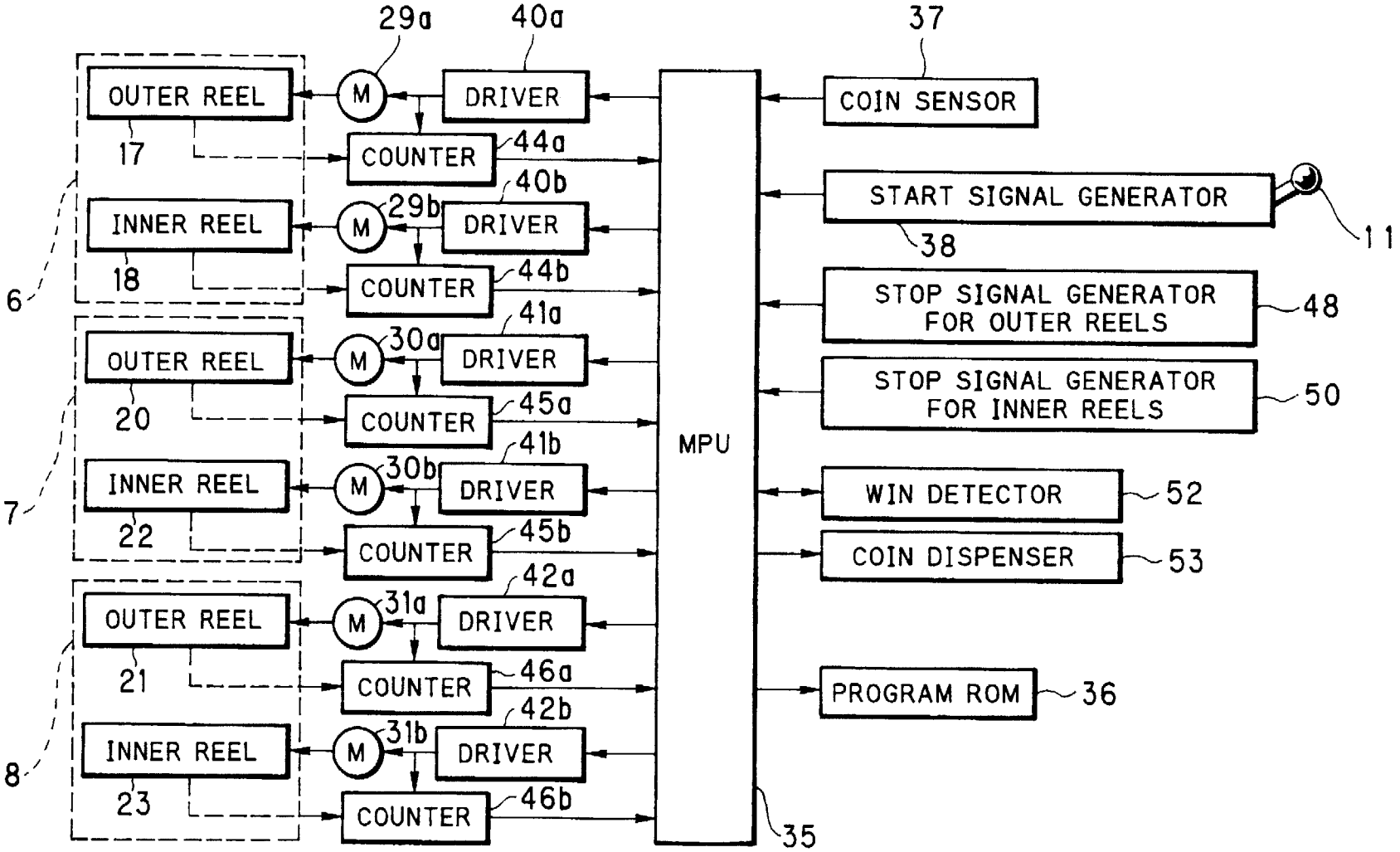
FIG. 6 is a block diagram illustrating an arrangement of relevant circuits of the slot machine.

FIG. 6 schematically illustrates the construction of the slot machine. A microprocessor unit (MPU) 35 executes a game in accordance with a sequence program stored in a program ROM 36. A coin sensor 37 detects a coin inserted through the coin slot 10, and sends a signal to MPU 35. A start signal generator 38 is responsive to operation of the start handle 11 or the spin button 14, and sends a start signal to MPU 35. In response to the start signal, MPU 35 causes the reel sets 6–8 to start rotating.

Rotation of the reel sets 6–8 is started by supplying drivers 40a, 40b, 41a, 41b, 42a and 42b with clock pulses from MPU 35. The drivers 40a–42b, in response to the clock pulses from MPU 35, supply the stepping motors 29a–31b with drive pulses at the frequency of the clock pulses.

Each of the stepping motors 29a–31b rotates through a regular angle upon receiving a drive pulse. The rotational angle by which the stepping motors 29a–31b have rotated can be detected by measuring the number of the drive pulses. There are counters 44a, 44b, 45a, 45b, 46a and 46b, associated with their respective drivers 40a–42b, to count the drive pulses. The stepping motors 29a, 30a and 31a respectively drive the outer reels 17, 20 and 21. The stepping motors 29b, 30b and 31b respectively drive the inner reels 18, 22 and 23. The outer reels 17, 20 and 21 rotate in the same direction as the inner reels 18, 22 and 23, but faster than the inner reels 18, 22 and 23.

At reset terminals of the counters 44a–46b, a reset pulse is input each time that the stepping motors 29a–31b have rotated past a home position of the rotation. Upon each reset pulse, the count is cleared as zero (0). The counts of the counters 44a–46b correspond to a rotational angle of the stepping motors 29a–31b within the range of one rotation.

The arrangement of the symbols about the reels 17, 18 and 20–23 is previously stored. Also symbols to appear in the display windows 3–5 when the stepping motors 29a–31b are stopped in their home positions are previously stored. It is possible always to determine the symbols that appear in the display windows 3–5 in accordance with the counts of the counters 44a–46b.

An outer reel stop signal generator 48 is actuated upon starting rotation of the outer reels 17, 20 and 21. Three stop signals for the outer reels are generated at random, and inputted to MPU 35. MPU 35 responds to the stop signals, to stop rotating the outer reels 17, 20 and 21. If the stop signal for the outer reel occurs during rotation of the first reel set 6, the driver 40a stops being supplied with the clock pulses. No drive pulses are supplied for the stepping motors 29a, so that the outer reel 17 stops rotating.

An inner reel stop signal generator 50 operates after the outer reels 17, 20 and 21 are stopped by the outer reel stop signals. The stop signal generator 50 randomly generates three inner reel stop signals, and sends them to MPU 35. MPU 35, in response, effects control of stopping of the inner reels 18, 22 and 23 in a manner similar to the stopping control of the outer reels 17, 20 and 21.

When the inner reel 18 stops, the patterned portions 19a–19c of the inner reel 18 appear through the transparent portions 81 and 84 of the outer reel 17. When the inner reels 22 and 23 stop, the patterned portions 19a–19c of the inner reels 22 and 23 appear through the transparent portions 81 and 84 of the outer reels 20 and 21. The symbols of the outer reels 17, 20 and 21 are visible in contrast with the patterned portions 19a–19c of the inner reels 18, 22 and 23. Even a beginning player can recognize the stopped combination of the symbols of the outer reels 17, 20 and 21. Also, the appearance of the player's game can have heightened distinction to other players around him.

After the reel sets 6–8 are stopped, a win detector 52 detects whether a symbol combination shown in the display windows 3–5 is a winning combination. Which kind of symbol appears in each of the display windows 3–5 can be determined according to the count of the counters 44a–46b. If the symbol combination in the display windows 3–5 is a winning combination, a coin dispenser 53 is actuated by a command of MPU 35, to pay out coins as a dividend, into the saucer 15.

The operation of the above slot machine will now be described. A coin is inserted into the coin slot 10. The start handle 11 or the spin button 14 is operated. In response, MPU 35 supplies the drivers 40a–42b with clock pulses. The drivers 40a–42b supply the stepping motors 29a–31b with drive pulses.

With the stepping motors 29a–31b driven by the drive pulses, the reel sets 6–8 start rotating at the same time. In FIG. 2, the outer reels 17, 20 and 21 and the inner reels 18, 22 and 23 are rotated in the counterclockwise direction. The outer reels 17, 20 and 21 are rotated at a higher speed than the inner reels 18, 22 and 23. The symbols on the outer reels 17, 20 and 21 are moved downward as observed through the display windows 3–5. The patterned portions 19a–19c on the inner reels 18, 22 and 23 are moved downwards as observed through the transparent portions 81 and 84 on the outer reels 17, 20 and 21, to let a player have continuous enjoyment in the game.

The present invention is of course also applicable to a slot machine in which the inner reels 18, 22 and 23 are rotated in opposite direction to the outer reels 17, 20 and 21.

When the reel sets 6–8 start to rotate, the stop signal generator 48 is actuated, and inputs three serial stop signals for the outer reels to MPU 35 at random. Then the outer reels 17, 20 and 21 are stopped from rotating. Only the symbols of the outer reels 17, 20 and 21 are stopped in the display windows 3–5.

In the case of a conventional symbol display device, a symbol combination would be finally determined in the display windows 3–5. There would be no possibility of further raising players' continuous enjoyment of a game. However, in the present invention, the stepping motors 29*a*–31*b* for the inner reels still rotate after the outer reels are stopped. The inner reels 18, 22 and 23 are rotated to keep observable the patterned portions 19*a*–19*c* through the transparent portions 81 and 84 of the outer reels 17, 20 and 21. It follows that players' continuous enjoyment in a game can be continued.

Figure 7:
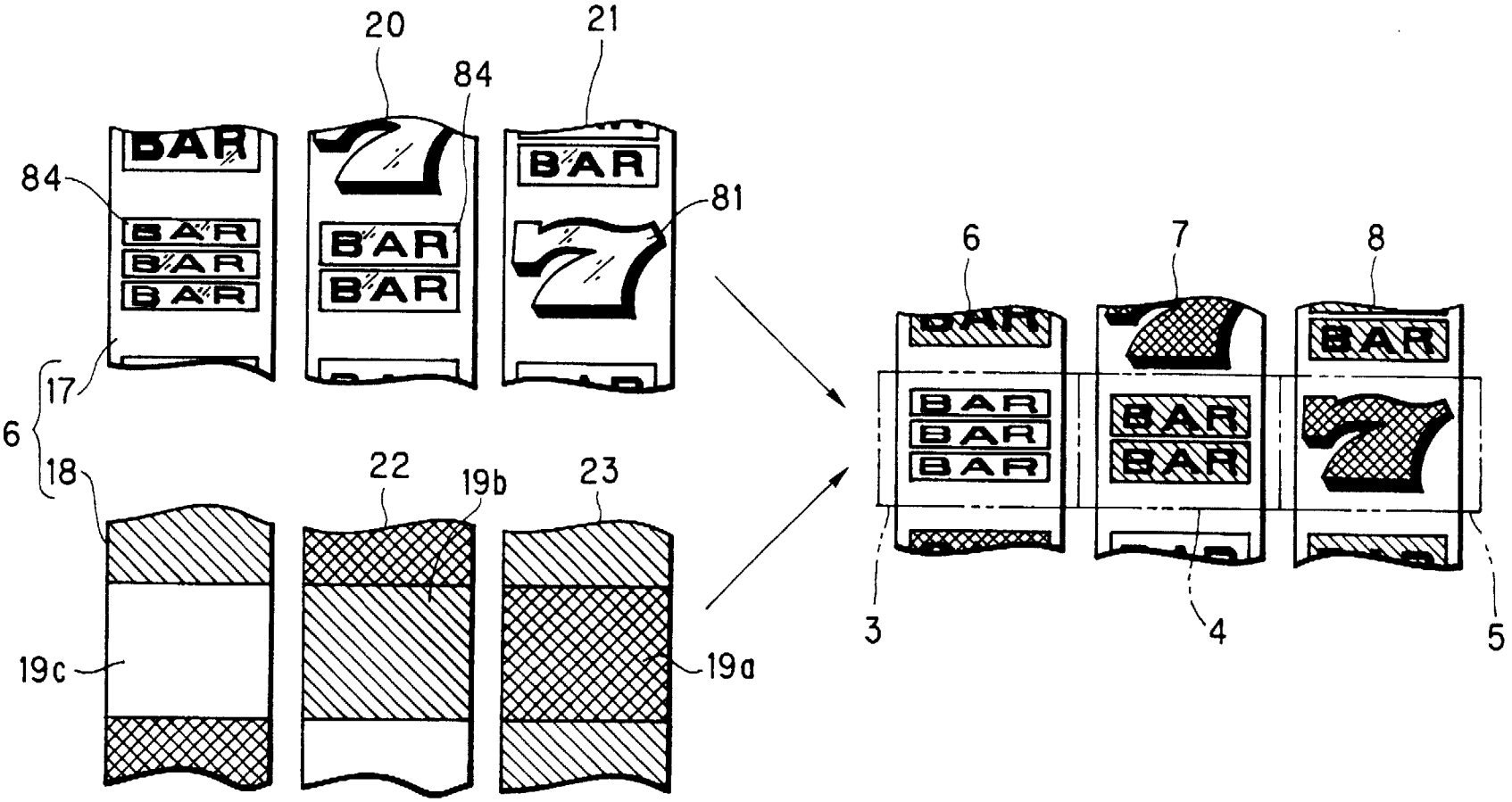
FIG. 7 is an explanatory view illustrating compound symbols in which symbols and patterned portions are combined.

After stopping the outer reel 17, the stop signal generator 50 is operated to input three serial stop signals for the inner reels to MPU 35 at random. Then the inner reels 18, 22 and 23 are stopped from rotating. All the reel sets 6–8 are stopped as illustrated in FIG. 7. Through the transparent portions 84 of the three BARs of the outer reel 17, the color white of the patterned portion 19*c* of the inner reel 18 is observed. Through the transparent portions 81 and 84 of the two BARs and "7" of the outer reels 20 and 21, BLUE and RED of the inner reels 22 and 23 are observed. There occur three compound symbols of "three BARs-WHITE", "two BARs-BLUE" and "7-RED".

MPU 35 refers to the counts in the counters 44*a*–46*b*, and determines which kind of the compound symbols appears in the display windows 3–5. Then compound symbol combination data, having been stored, are referred to by the win detector 52 according to the determined compound symbols. The win detector 52 determines whether a win is acquired. If the win detector 52 determines that a win is acquired, then MPU 35 drives the coin dispenser 53 to pay out into the saucer 15 coins in the number associated with the winning combination. The game is thus ended.

The symbol combination of FIG. 7 is not a winning combination. There are plural kinds of wins, including small and big wins. A small win is given when stopped symbols of the outer reels 17, 20 and 21 are the same, or when stopped colors of the patterned portions 19*a*–19*c* of the inner reel 18, 22 and 23 are the same. A big win is given when stopped symbols of the outer reels 17, 20 and 21 are the same, and also stopped colors of the patterned portions 19*a*–19*c* of the inner reels 18, 22 and 23 are the same. The winning combination and a dividend can be changed by changing data preset in the win detector 52.

In the above embodiment, the outer and inner reels are stopped by the stop signal generators 48 and 50. However, it is possible that there can be stop buttons which can be depressed by a player to stop the outer reels at desired times. Also, it is possible that each of the outer and inner reels can be manually stopped through stop buttons at desired times.

Other modifications of the games are possible: the outer and inner reels can be stopped at the same time. When either the outer reels or the inner reels are stopped to acquire at least a small win, the remaining three of the reels can be rotated again. The repeated rotation may be effected at a changed speed, for the purpose of increasing the chances for a higher dividend.

Figure 8:
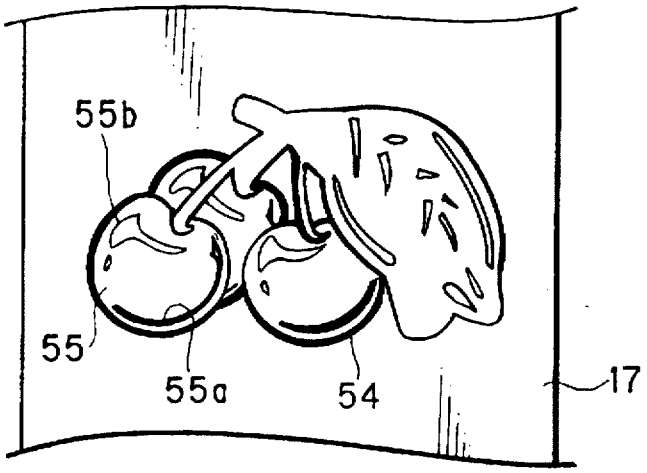
FIG. 8 is an explanatory view illustrating still another preferred manner of forming a symbol.

The symbols on the outer reels may include CHERRY in FIG. 8, BELL or ORANGE, in addition to BAR and "7". Note that the CHERRY has a complicated shape which is difficult for players to recognize simply according to a border 54. It is thus preferable that a transparent portion 55 have opaque portions 55*a* and 55*b* which may be colored differently. It is also possible to color the border 54 in plural colors, including red for cherries and green for leaves. This is advantageous for increasing players' continued enjoyment of the games.

The patterned portions of the inner reels may have yellow and green colors and the like, in addition to white, red and blue, in a color range suitable for easy discernment. Also the patterned portions of the inner reels may have signs, a pattern, or a picture such as a landscape. It is possible that a picture can be formed as a compound symbol, by combining one of the symbols of the outer reels with one of the patterned portions of the inner reels.

The reels can have suitably determined rotational speeds, rotational directions, and stopping order, which are not limited to what is disclosed above. Three reel sets are used, but it is also possible to use two reel sets, or nine reel sets arranged in a matrix. Through the display windows 3–5, as described above, one winning line is formed by three symbols appearing at one time, but it is also possible to use two or three winning lines formed horizontally. Furthermore, diagonal winning lines may be determined.

Figure 9:
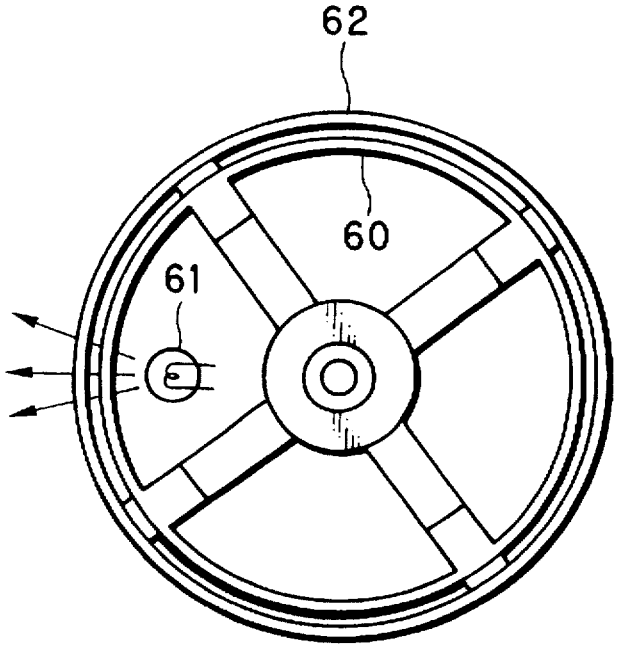
FIG. 9 is an explanatory view in elevation, illustrating another preferred reel set having a lamp.

To increase the ease of recognition of the symbols through the symbol display windows, it is possible to position a lamp or illuminating unit 61 within the reels. In FIG. 9, an inner reel 60 is formed from transparent resin. The patterned portions are formed from a coating of translucent paint. The lamp 61 is incorporated in the inner reel 60. Illuminating light from the lamp 61 is applied to illuminate an outer reel 62.

Figure 10:
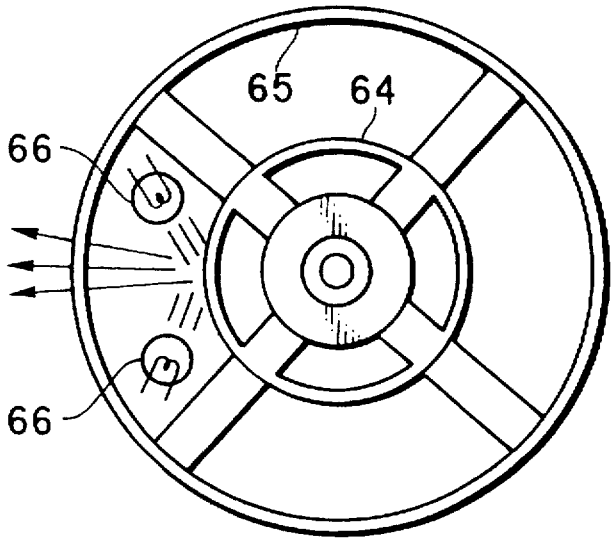
FIG. 10 is an explanatory view in elevation, illustrating still another preferred reel set having a lamp.

In FIG. 10, an inner reel 64 may have a reduced diameter. A lamp or illuminating unit 66 may be disposed between the inner reel 64 and an outer reel 65, to emit illuminating light, which can be reflected by the inner reel 64 to illuminate the outer reel 65. Also, it is possible to attach a luminous painted sheet or colored sticker to the peripheral face of the inner reel 64. The illuminating light, when desired, can be applied to the luminous painted sheet, to render the symbols more sharply visible.

The above embodiment is directed to the reel type of symbol display device. The present invention is also applicable to a video type of symbol display device. A CRT (cathode ray tube), a liquid crystal display panel, or a display panel of LEDs (light-emitting diodes) arranged in a matrix may be used, and operated to display the symbol borders and the patterned portions in overlaid fashion. The symbol border lines and the patterned portions are shown in movement during their individually determined phases. When a stop signal occurs, the movement is stopped, to display a single compound symbol obtained from one symbol border line and one patterned portion.

Figure 11:
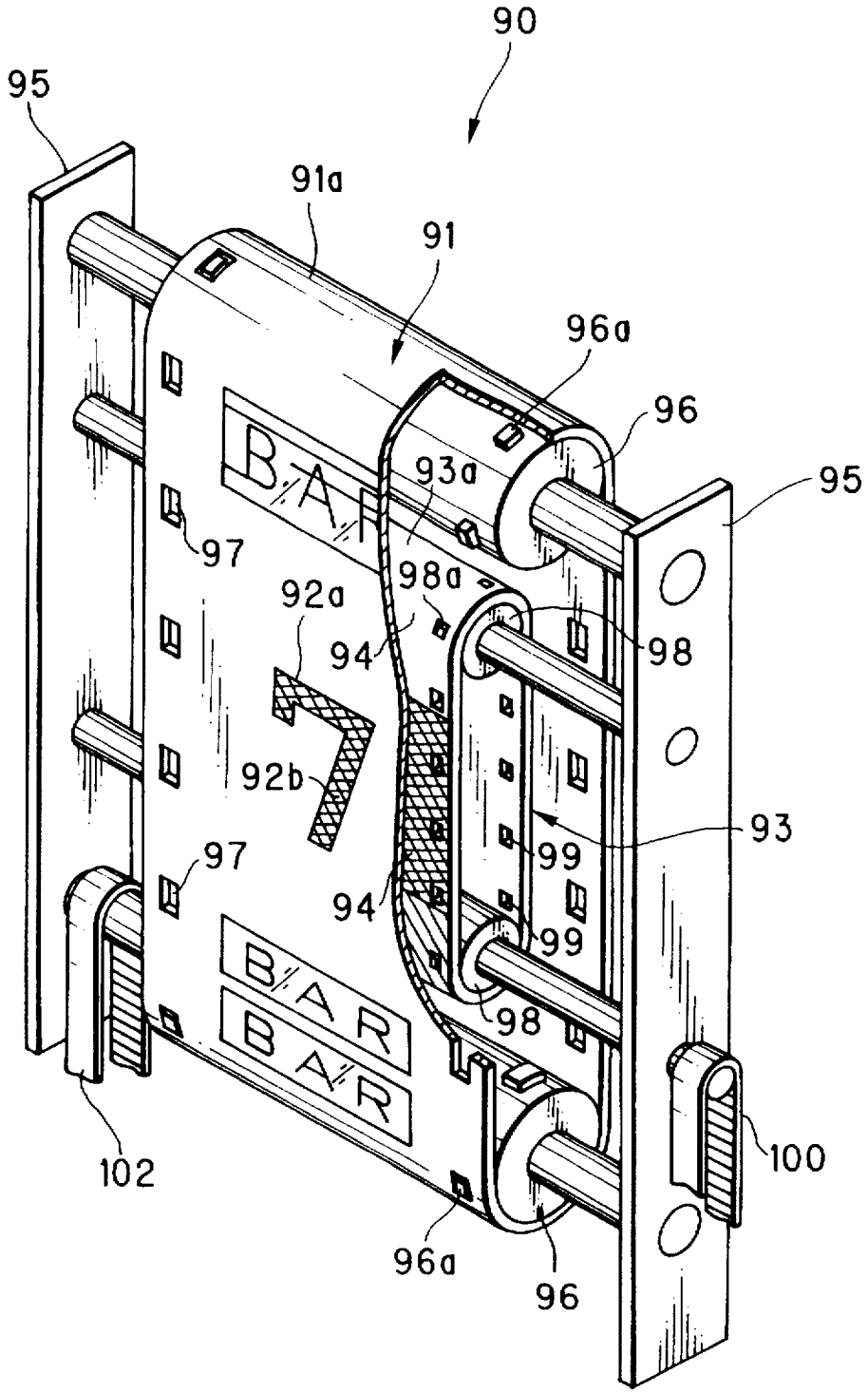
FIG. 11 is a perspective view illustrating a belt set according to another preferred symbol display device.

FIG. 11 illustrates a symbol display device having a belt construction. A symbol display device 90 has an endless outer belt 91 and an endless inner belt 93. The outer belt 91 has an opaque peripheral face 91*a*, on which plural kinds of symbols are arranged, these symbols including opaque border lines 92*a* and transparent portions 92*b*. The inner belt 93 has a peripheral face 93*a* on which plural kinds of patterned portions 94 are arranged in plural colors.

The outer belt 91 is mounted on the periphery of a pair of rollers 96, which are rotatably supported on a frame 95. When the rollers 96 rotate, the outer belt 91 is circulated. Two trains of perforations 97 are formed in the outer belt 91 along its edges, and these mesh with sprocket teeth 96*a* of the rollers 96. No slippage occurs between the outer belt 91 and the rollers 96. The outer belt 91 does not have an irregular position.

The inner belt 93 is mounted on the periphery of a pair of rollers 98, which are supported on the frame 95 rotatably. Two trains of perforations 99 are formed in the inner belt 93, and meshed with sprocket teeth 98*a* of the rollers 98. Respective distal ends of the rollers 96 and 98 are toothed gears, with which timing belts 102 and 100 are engaged. The timing belts 102 and 100 are driven by stepping motors, to rotate the rollers 96 and 98 and move the belts 91 and 93 vertically. The symbol display device 90 of the belt type is generally controlled by the circuitry of the above-described reel type of the symbol display device. Similar effects can be obtained from the symbol display device 90.

The belt type of symbol display device can have a smaller size than the reel type of symbol display device, by changing arrangement of rollers and a belt.

Figure 12:
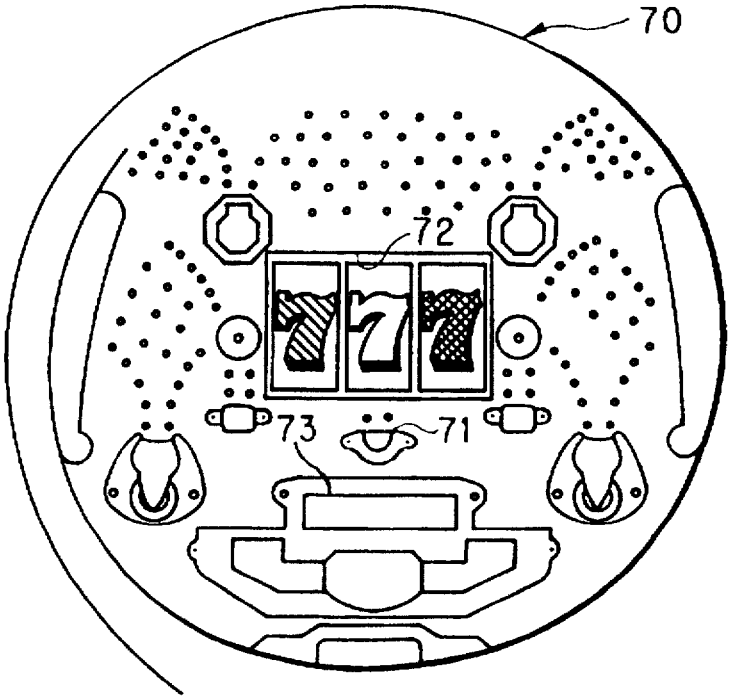
FIG. 12 is a front elevation illustrating a pinball machine in which an endless belt symbol display device is used.

The symbol display device of the present invention is also applicable to a pinball machine 70 of FIG. 12. The pinball machine 70 has a bonus winning display window 72, behind which the symbol display device of the present invention is incorporated. A winning ball receiving hole or advantage hole 71 is adapted to start operating the symbol display device. When a ball enters the advantage hole 71 after a player starts a game, then the outer and inner reels are rotated in a similar manner to the slot machine above. A random timer generates stop signals, in response to which the outer and inner reels are stopped. If a combination of compound symbols on the outer and inner reels is detected to be a winning combination, then an openable big receiver 73 is opened for a predetermined duration, to facilitate entry of balls.

Note that one, two, four or more symbol display devices may be incorporated in the pinball machine 70. The pinball machine 70 may incorporate a video type or a belt type of symbol display device. The present invention is applicable to a slot machine, a pinball machine, and any other gaming machine incorporating at least one symbol display device.

The present invention is applicable to a combination of a reel type and a video type, and to a combination of a belt type and a video type. Namely, each inner reel can be constructed from a CRT (cathode ray tube), a liquid crystal display panel, a display panel of LEDs (light-emitting diodes) arranged in a matrix, and combined with one mechanical outer reel or belt, to show compound symbols externally.

Again, it is possible that a gaming machine of the present invention can be provided with a structure for emitting a decorative illumination or sound as external effects.

In the above embodiments, all the symbols have respective transparent portions. The present invention is applicable to a symbol display device in which at least one symbol has a transparent portion.

In the above embodiments, all the transparent portions have a shape specific to the kind of symbol associated therewith. All the opaque portions of the symbols have a shape specific to the kind of each symbol. The present invention is applicable to a symbol display device in which all the transparent portions have an equal shape despite the plural symbols associated therewith. The present invention is applicable to a symbol display device in which all the opaque portions of the symbols have an equal shape, and in which all the transparent portions have a shape specific to the kind of symbol associated therewith.

In the above embodiment, the outer reel 17 has a peripheral face 17*a* which is opaque and white. The present invention is applicable to a symbol display device with the outer reel 17 of which the peripheral face 17*a* has an opaque color different from white.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as being included therein.

What is claimed is:

1. A symbol display device for a gaming machine, having a display window wherein any of a plurality of different symbols is stopped, said symbol display device comprising:

an outer reel, rotatable behind said display window, and having a peripheral face with said symbols spaced apart peripherally thereon;

said symbols including at least one transparent portion comprising a transparent symbol and said symbols also including an opaque portion which is visually distinct from said peripheral face, said peripheral face of said outer reel being opaque outside said transparent portion and said opaque portion of said symbols;

an inner reel rotatable inside said outer reel;

a plurality of different patterned portions, arranged on a peripheral face of said inner reel, any of said patterned portions being adapted to be stopped in said display window;

whereby one of said patterned portions stopped in said display window is observable through said transparent symbol when said transparent symbol is stopped in said display window, and is combined with said transparent symbol, so as to constitute a compound symbol.

2. A symbol display device as defined in claim 1, wherein each of said symbols on said outer reel comprises a said transparent portion.

3. A symbol display device as defined in claim 1, wherein said peripheral face of said outer reel is formed at least partially from transparent material, and said transparent portion is formed by coloring said peripheral face of said outer reel around said transparent portion.

4. A symbol display device as defined in claim 1, wherein said opaque portion is formed within said transparent portion by coloring.

5. A symbol display device as defined in claim 1, wherein said opaque portion is formed around said transparent symbol, and is colored differently from said peripheral face of said outer reel.

6. A symbol display device as defined in claim 1, wherein said transparent symbol comprises an opening formed in said outer reel.

7. A symbol display device as defined in claim 6, further comprising a transparent member secured to said outer reel, for closing said opening.

8. A symbol display device as defined in claim 1, further comprising a lamp, disposed behind said display window, for illuminating said transparent symbol.

9. A symbol display device as defined in claim 8, wherein said patterned portions are at least partially translucent, said lamp is disposed inside said inner reel, and light from said lamp is transmitted through said patterned portion and said transparent symbol.

10. A symbol display device as defined in claim 8, wherein said patterned portions at least partially have high optical reflectance, said lamp is disposed between said outer reel and said inner reel, and light from said lamp is reflected by said patterned portion and then transmitted through said transparent symbol.

11. A gaming machine, incorporating at least one symbol display device having a display window wherein any one of a plurality of different symbols is stopped, wherein a win or loss is determined according to the symbols stopped in the window;

each said at least one symbol display device comprising a symbol display device as claimed in claim 1;

wherein said win or loss is determined in consideration of a said compound symbol stopped in a said display window, or in consideration of a combination of a plurality of said compound symbols stopped in plural said display windows.

12. A gaming machine, incorporating at least one symbol display device having a display window wherein any one of a plurality of different symbols is stopped, wherein a win or loss is determined according to the symbols stopped in the window;

each said at least one symbol display device comprising a symbol display device as claimed in claim 11;

wherein said win or loss is determined in consideration of a said compound symbol stopped in a said display window, or in consideration of a combination of a plurality of said compound symbols stopped in plural said display windows.

13. A symbol display device for a gaming machine, having a display window wherein any of a plurality of different symbols is stopped, said symbol display device comprising:

a first pair of rollers, respectively disposed behind two opposite sides of said display window, for rotating in synchronism;

an endless outer belt, disposed behind said display window, supported on and circulated by said first pair of rollers, said endless outer belt having a peripheral face with said symbols spaced apart therealong;

said symbols including at least one transparent symbol, said peripheral face of said outer belt being opaque outside said transparent symbol;

a second pair of rollers, disposed between said first pair of rollers, for rotating in synchronism;

an endless inner belt, disposed behind said display window, supported on and circulated by said second pair of rollers;

a plurality of different patterned portions, arranged on a peripheral face of said inner belt, any of said patterned portions being adapted to be stopped in said display window;

whereby one of said patterned portions stopped in said display window is observable through said transparent symbol when said transparent symbol is stopped in said display window, and is combined with said transparent symbol, so as to constitute a compound symbol.

14. A symbol display device for gaming machine, having a display window wherein any one of a plurality of different text and graphic symbols is stopped, said symbol display device comprising:

an outer reel rotatable behind said display window and having a peripheral face with a plurality of text and graphic symbols spaced apart peripherally thereon;

said symbols including at least one transparent portion comprising a transparent one of said symbols and an opaque portion which defines a text or graphic content of said transparent symbol, said peripheral face of said outer reel being opaque outside said transparent portion;

an inner reel rotatable inside said outer reel;

a plurality of different patterned portions arranged on a peripheral face of said inner reel, any of said patterned portions being adapted to be stopped in said display window, wherein one of said patterned portions stopped in said display window is observable through said transparent symbol when said transparent symbol is stopped in said display window, and is combined with said transparent symbol to form a compound symbol.

15. The symbol display device of claim 14, wherein each of said patterned portions consists essentially of a color which is visually distinct from said peripheral face.

* * * * *